US007435921B2

(12) United States Patent
Rae et al.

(10) Patent No.: US 7,435,921 B2
(45) Date of Patent: Oct. 14, 2008

(54) ENCLOSURE FOR ELECTRONIC DEVICE

(75) Inventors: Patrick A. M. Rae, Media, PA (US); Roland M. Wolstenholme, Laurel Springs, NJ (US); Justin M. Mazzoni, Broomall, PA (US)

(73) Assignee: La France Corporation, Concordville, PA (US)

( * ) Notice: Subject to any disclaimer, the term of this patent is extended or adjusted under 35 U.S.C. 154(b) by 74 days.

(21) Appl. No.: 11/470,284

(22) Filed: Sep. 6, 2006

(65) Prior Publication Data

US 2008/0053802 A1 Mar. 6, 2008

(51) Int. Cl.
*H01H 13/04* (2006.01)

(52) U.S. Cl. ..... 200/333; 200/517

(58) Field of Classification Search ..... 200/512–520, 200/333

See application file for complete search history.

(56) References Cited

U.S. PATENT DOCUMENTS

| | | | | |
|---|---|---|---|---|
| 4,400,596 | A * | 8/1983 | Fukukura et al. | 200/5 A |
| 5,940,015 | A * | 8/1999 | Thornton et al. | 341/20 |
| 6,271,487 | B1 * | 8/2001 | Domzalski et al. | 200/1 B |
| 6,462,294 | B2 * | 10/2002 | Davidson et al. | 200/512 |
| 6,621,017 | B2 * | 9/2003 | Shibutani et al. | 200/5 A |
| 6,646,864 | B2 | 11/2003 | Richardson | |
| 6,737,596 | B1 * | 5/2004 | Hein | 200/310 |
| 6,995,976 | B2 | 2/2006 | Richardson | |
| 7,102,093 | B1 * | 9/2006 | Chiu | 200/341 |
| D530,079 | S | 10/2006 | Thomas | |
| 7,158,376 | B2 | 1/2007 | Richardson | |
| 7,180,735 | B2 | 2/2007 | Thomas | |
| 2005/0127123 | A1 | 6/2005 | Smithers | |
| 2006/0061950 | A1 | 3/2006 | Richardson | |
| 2006/0274493 | A1 | 12/2006 | Richardson | |
| 2006/0279924 | A1 | 12/2006 | Richardson | |

OTHER PUBLICATIONS

Pages from XtremeMac Website, Oct. 31, 2006 and Nov. 1, 2006.
ProtecT Computer Products—Laptop Covers, website, Jul. 17, 2006.
Custom keyboard covers, laptops cover, screen protectors and more, website, Jul. 17, 2006.
ProtecT Computer Products—website, Jul. 20, 2006.
Crystal Covers, website, Jul. 24, 2006.
Buy PC Supplies.com, website, Jul. 24, 2006.
Clear Shield Phone Protector Case w/Belt Clip for Palm Treo 700p 700w 650, website, Jul. 24, 2006.
Home & Home Office: Cherrywood QuickSnap Color Kit for Dell Inspiron 9200 Notebook, website, Jul. 24, 2006.

* cited by examiner

*Primary Examiner*—Michael A. Friedhofer
*Assistant Examiner*—Lisa N Klaus

(57) ABSTRACT

An enclosure for an electronic device includes a base having an outwardly extending peripheral wall which forms a compartment for receiving the electronic device. A caseplate is mounted to the peripheral wall for enclosing the electronic device. The caseplate has an access opening extending completely through the caseplate and located at a switch on the electronic device. The access opening is covered by a thin membrane which protects the electronic device and yet permits actuation of the switch. The caseplate can be decorated by art work on by another layer of material or can be clear and cover the device and an optional art work insert.

28 Claims, 4 Drawing Sheets

10
6
38
40
42
28
17
23
36
44
22
18
30
32
16
34
20
24
26

ENCLOSURE FOR ELECTRONIC DEVICE

BACKGROUND OF THE INVENTION

It is known to provide various electronic devices with enclosures or cases. Such types of electronic devices include, for example, PDA's and music players such as MP3 players and personal recorders. A common form of MP3 player is Ipod manufactured by Apple Computers. Such devices generally have manually actuatable switches on an outer surface. During use the repetitive touching of the switches and other parts of the electronic device by the user's fingers causes deterioration of, for example, the art work on the electronic device. It is also known to provide diverse devices, such as laptop computers and telephones with protective covers over the keyboards or tactile areas.

It would be desirable if some form of protective cover could be provided over the switch of an electronic device without inhibiting actuation of the switch.

SUMMARY OF THE INVENTION

An object is to provide an enclosure for an electronic device having a switch on its outer surface wherein the enclosure provides an overcover to protect the switch and art work of the electronic device.

A further object of this invention is to provide such an enclosure which can be manufactured and assembled in an efficient manner.

In accordance with this invention the enclosure includes a case having a bottom wall with an outwardly extending peripheral wall to form a compartment for receiving the electronic device. A caseplate is mounted over the peripheral wall to enclose the electronic device. The caseplate has an access opening extending completely through it at the location of the switch. A thin membrane liner is mounted in surface to surface contact with the caseplate and completely covers the access opening to thereby also cover the switch. The membrane has a tactile region at the access opening to readily permit manipulation of the switch by pressing against the tactile region.

The membrane liner may be mounted to the caseplate in various manners such as by an in-molded process with the caseplate or by being adhesively secured to the caseplate.

The housing could include an opening in one wall to permit the insertion and removal of a card which would change the nomenclature on the electronic device. The peripheral wall may include a gasket so that when the caseplate is snapped into engagement with the peripheral wall a hermetic seal is formed at that engagement.

THE DRAWINGS

DETAILED DESCRIPTION

Figure 1:
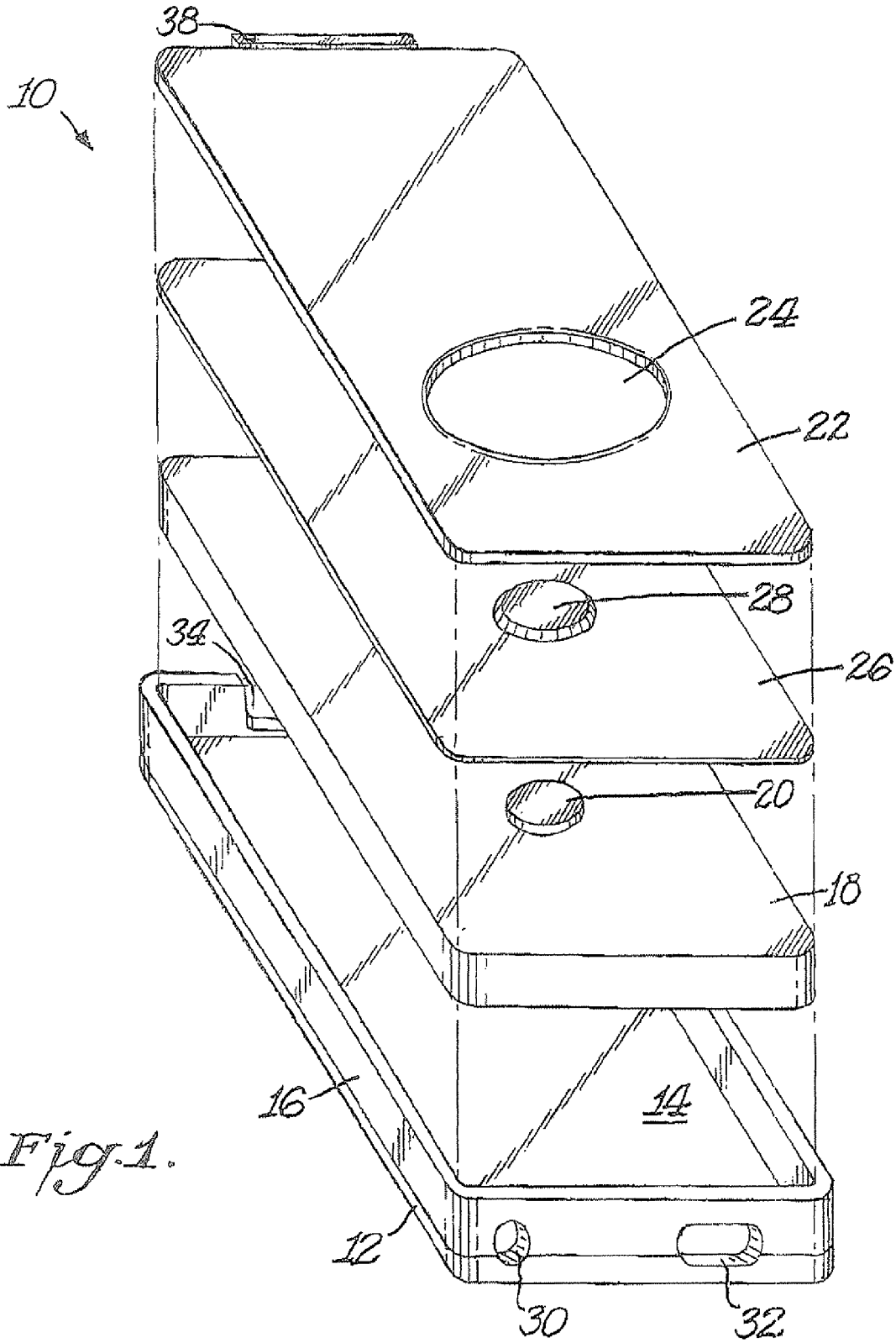
FIG. 1 is an exploded view of an enclosure mounting an electronic device in accordance with one embodiment of this invention.

FIG. 1 illustrates an enclosure 10 in accordance with one embodiment of this invention. As shown therein, the enclosure 10 includes a case 12 having a bottom wall 14 and an outwardly extending peripheral wall 16 to form a compartment for receiving electronic device 18. Electronic device 18 includes a switch 20 on its outer surface remote from the base or bottom wall 14. A caseplate 22 would be mounted to the peripheral wall 16, preferably by any suitable detachable mounting so that the caseplate and case can be snapped together to enclose the electronic device 18. The case 12 and caseplate 22 could be made of any suitable material in any suitable manner. Preferably, the case and caseplate are injection molded of rigid plastic material which could be clear or of various colors.

Figures 2, 3, 4, 5, 6, 7, 11:
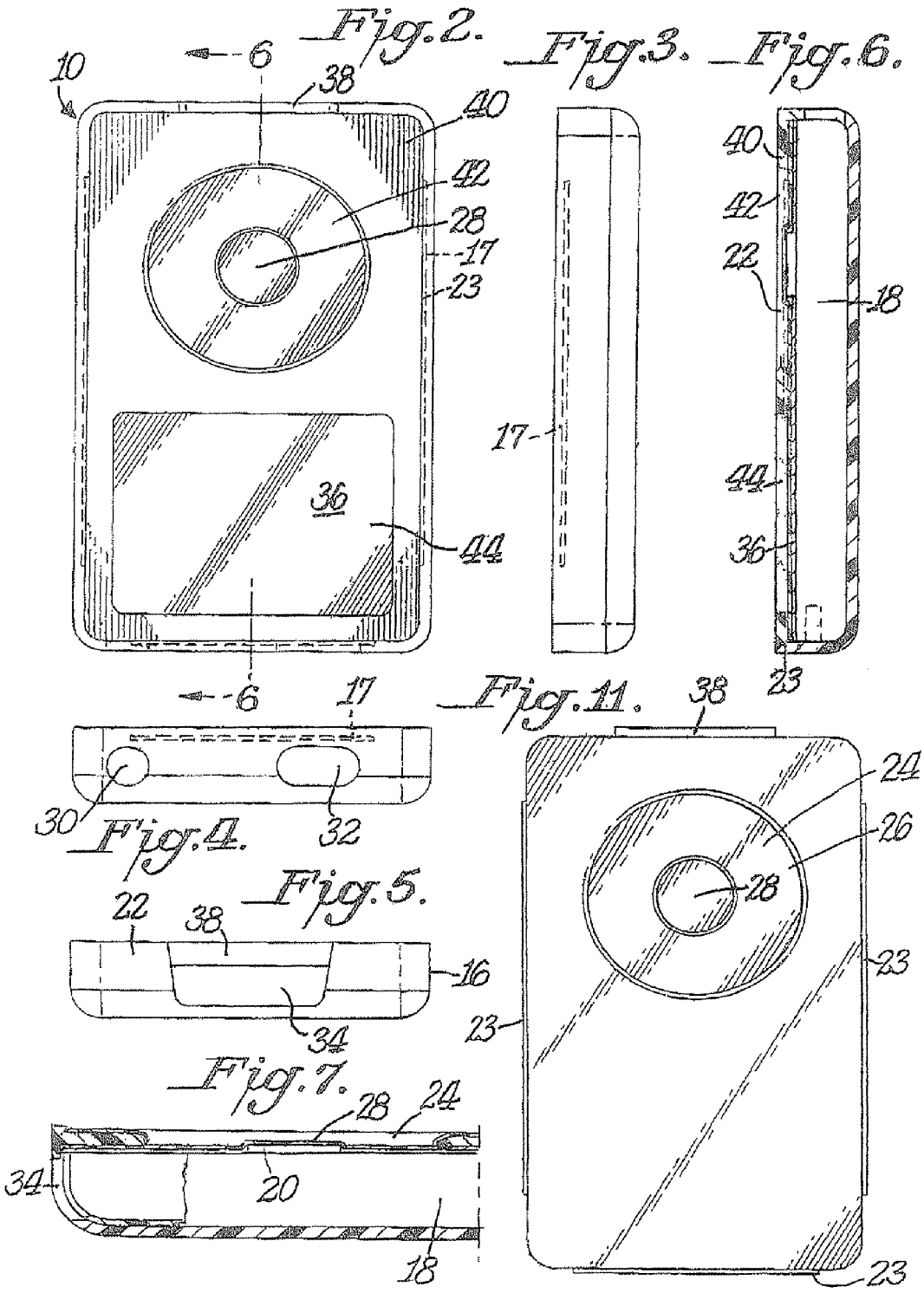
FIG. 2 is a top plan view of the enclosure of FIG. 1 in its assembled condition and shows a partial overlayer.
FIG. 3 is a side elevational view of the enclosure of FIG. 2.
FIGS. 4-5 are end elevational views of the enclosure of FIGS. 2-3.
FIG. 6 is a cross-sectional view taken through FIG. 2 along the lines 6-6.
FIG. 7 is a cross-sectional view in elevation of a portion of the enclosure shown in FIGS. 1-6.
FIG. 11 is a top plan view of the enclosure of FIG. 9-10.

Caseplate 22 has an interior wall disposed toward the base 14 and an exterior wall which would form the outer wall of the enclosure. An access opening 24 extends completely through the caseplate and would be located directly above the switch 20 of device 18. In accordance with this invention a liner in the form of a thin membrane 26 is mounted to caseplate 22 in surface to surface contact. Liner 26 completely covers access opening 24. In the preferred practice of this invention liner 26 is of the same size and shape of the surface of caseplate 22 which it contacts. The invention, however, could be broadly practiced where liner or membrane 26 is large enough to cover access opening 24 without necessarily being in surface to surface contact with the entire caseplate 22. Liner 26 is made of any suitable material such as a polyester and is sufficiently thin so that a tactile region 28 is formed at the location of switch 20 to permit switch 20 to be manipulated by touching the tactile region 28 such as by pressing inwardly against switch 20. Tactile region 28 could be considered to coplanar with its adjacent portion of membrane 28 although it could project slightly inwardly or preferably outwardly, as illustrated in FIG. 7 to accommodate switch 20. Switch 20 could be of any suitable known type, such as a capacitance switch. The thin plastic membrane or liner 26 may be considered as covering mechanical, electrical, capacitive or any other type of switch on the device 18.

Figure 9:
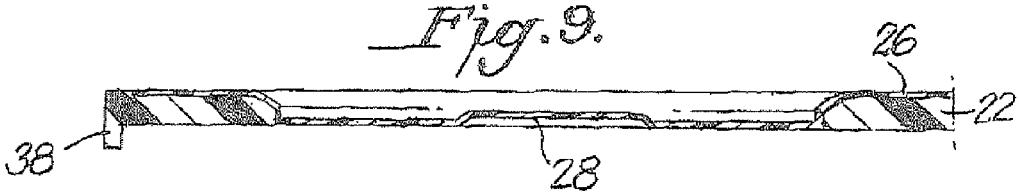
FIG. 9 is a cross-sectional view in elevation of a modified form of caseplate.
Figure 10:
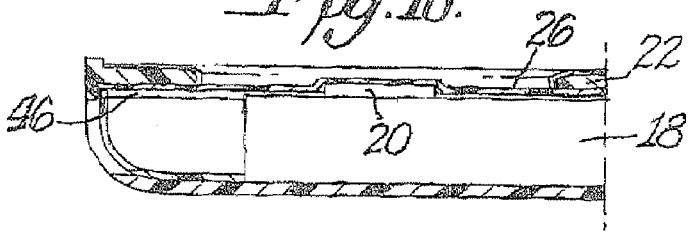
FIG. 10 is a cross-sectional view in elevation of a portion of the assembled enclosure of the embodiment of FIG. 9.

Liner 26 is preferably made of a transparent material to readily permit the switch 20 to be seen. Liner 26 could be secured to either the interior wall of caseplate 22, such as illustrated in FIG. 1 or to the exterior wall as illustrated in FIGS. 9-10. Liner 26 could be mounted to caseplate 22 in any suitable manner, such as by laminating the thin plastic sheet stock to the caseplate 22 wherein the caseplate 22 could be formed sheet metal or injection molded plastic. The lamination or mounting could be done using any suitable water clear adhesive. Such adhesive could be applied to the contacting surface of caseplate 22 and/or the contacting surface of liner 26. The liner 26 can be embossed if desired. Preferably, the surface of the liner 26 is flat but could follow the contour of the device 18 that it encloses, particularly when caseplate 22 is contoured.

Device 18 would be any suitable electronic device such as a music player or Ipod. Case 12, and particularly peripheral wall 16, is provided with various openings 30,32,24 to accommodate members or attachments associated with device 18 such as earphones, neck lanyards or various electrical cords.

The thin plastic membrane or liner 26 preferably has a thickness ranging from 0.005 inches to 0.020 inches to assure that the switch 20 can be manipulated, particularly through the tactile region 28 and yet be sufficiently thick to provide an overcoat to be a protective liner. The thin membrane, particularly in the tactile region 28 allows the user to access the mechanical, electrical, capacitive or any other type of switch through the enclosure 10. The surface and the thin plastic membrane 26 can contain color, can contain art work or can be water clear. If the surface of caseplate 22 with the thin plastic membrane 26 is water clear art work in a flat or 3D form can be placed in between the enclosure and device or the art work can be incorporated in membrane 26. FIG. 6, for example, shows a card 36 which would be located between device 18 and caseplate 22. This allows for placement of the art work over the switches. This also allows for interchangeable and customized art work by the end user and for changes in nomenclature on the electronic device. The thin membrane or liner 26 protects the art work, any nomenclature on the art work and the switch from wear, dust and liquids. This thereby replaces the need for pressure sensitive labeling. Both the thin membrane 26 and the art work have dimensional stability and can be indexed. The thin plastic membrane is permanently bonded to the surface of caseplate 22. Such permanent bond between the surface 22 and the thin plastic membrane can aid in hermetically sealing the enclosure if desired, as later described.

Figure 12:
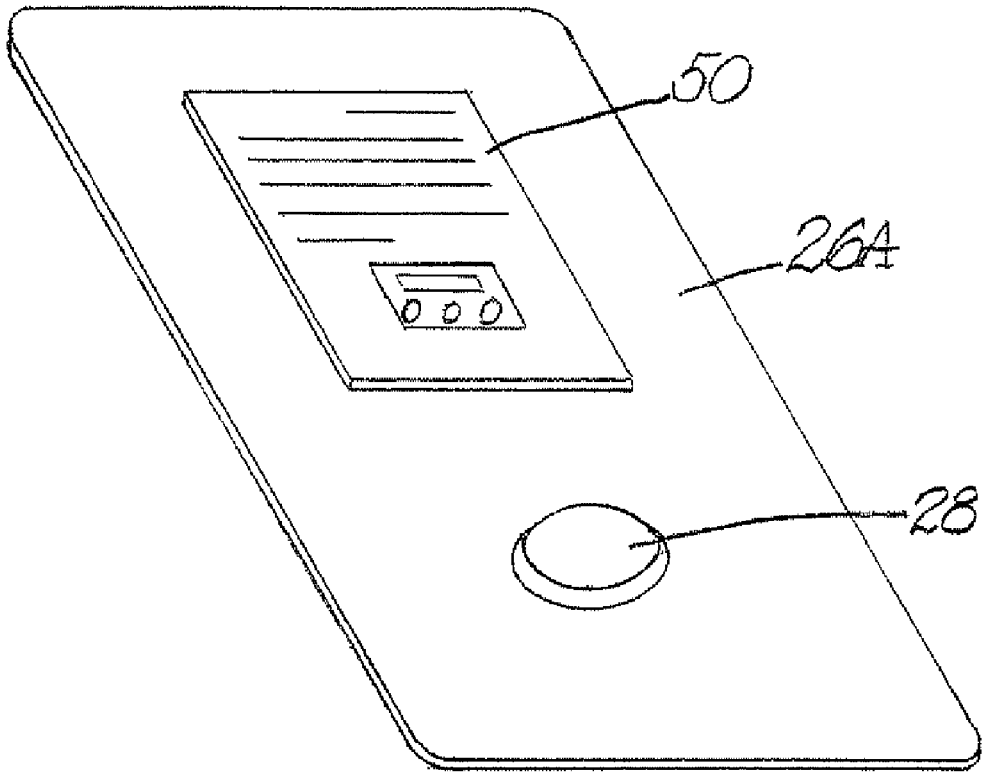
FIG. 12 is a perspective view of a membrane having three-dimensional artwork.

FIG. 12 is a perspective view of the lower surface of a modified membrane 26A having art work in the form of three-dimensional art work 50 on its lower surface. Thus, as previously described the art work would be placed in between the enclosure and the device, As specifically shown in FIG. 12 this is done by incorporating the art work in the membrane.

Caseplate 22 is preferably detachably mounted to case 12. This could be done by simply snapping the caseplate with its mounted membrane 26 into and within the peripheral wall 16. This may be done by projections 23 extending outwardly from the caseplate side edges (see FIGS. 2 and 11) snapping into elongated grooves 17 in the peripheral wall 16. In the illustrated embodiment caseplate 22 also includes a downwardly extending flange 38 which would fit into the top of opening 34 in wall 16, as shown in FIG. 5.

As illustrated caseplate 22 is snapped into detachable engagement with case 12 by being pushed into and fitting tightly against the inner surface of peripheral wall 16. The caseplate and peripheral wall are dimensioned so that when the caseplate 22 is mounted in place it terminates coplanar with the outer edge of peripheral wall 16. Caseplate 22 could be lower than and parallel to the outer edge of peripheral wall 16, so that the peripheral wall forms a lip to help protect the exterior surface of caseplate 22 from scratches. As indicated flange 38 extends downwardly into opening 34 of peripheral wall 16. This also forms part of the engagement of the caseplate 22 with peripheral wall 16. In addition, the location of the hole 34 particularly since it extends completely to the caseplate provides a convenient manner of being able to push the caseplate 22 outwardly for disengaging the caseplate 22 from the case 12.

The provision of flange 38 at opening 34 facilitates the detachability of caseplate 22 from case 12 since the opening 34 provides a region where the finger or a tool could be inserted and pushed outwardly against the flange 38 to dislodge caseplate 22 from within peripheral wall 16. Other form of detachable engagement could be used such as interlocking structure on the caseplate and peripheral wall. As shown in FIG. 10 a gasket 46 could be located at or near the exposed outer edge of peripheral wall 16 so that when the caseplate is snapped into engagement with wall 16 a hermitic seal is formed at the area of engagement.

Figure 8:
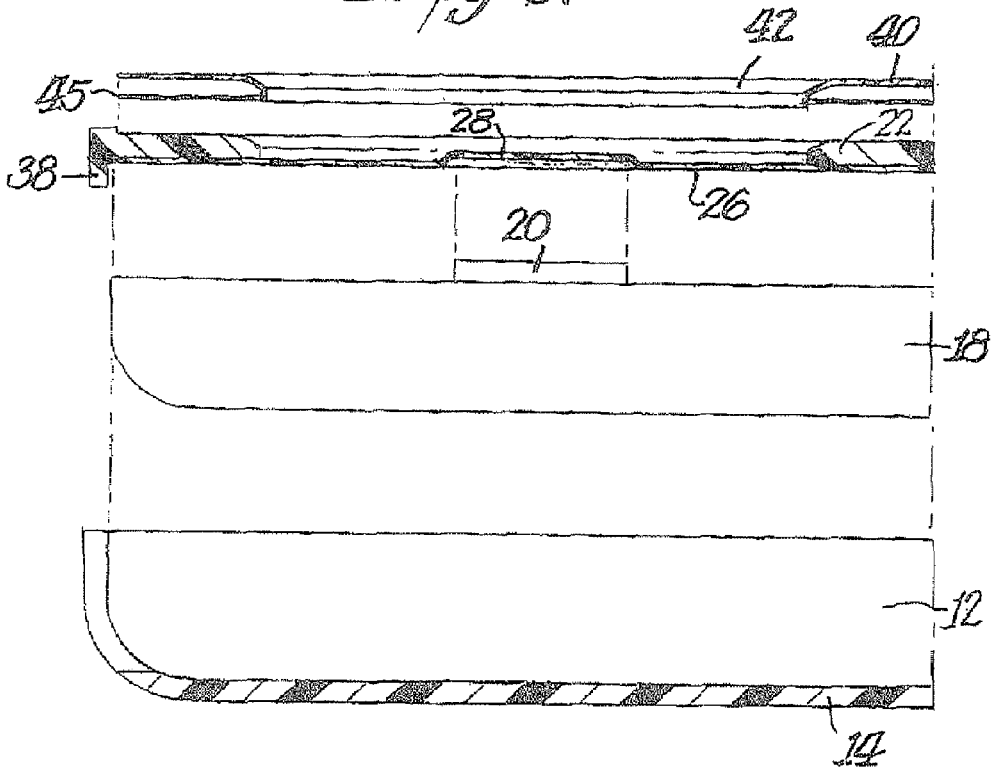
FIG. 8 is an exploded view in section of the enclosure of FIGS. 2-7.

FIGS. 2, 6 and 8 show a variation of enclosure 10 where a partial layer 40 of decorative material is mounted to the exterior surface of caseplate 22. The decorative material would not completely cover the exterior surface, but rather would leave open areas 42,44 if desired to provide visibility through the outer surface of the enclosure so that the comparable portions of the electronic device could be seen. An example of the outer layer could be a texturized/colored co-molded rubber.

As shown in FIG. 8 the partial liner 40 has an adhesive layer 45 on its under surface for securement to the exterior surface of caseplate 22. Alternatively, or in addition, the adhesive layer could be placed on the exterior surface of caseplate 22. It is preferred, however, to provide the adhesive solely on the lower layer of partial layer 40 to avoid exposed adhesive being in the open areas 42,44 of the partial layer which would otherwise result if a complete adhesive layer were placed on the exterior surface of caseplate 22.

As is apparent from, for example, FIG. 8, when the partial layer 40 becomes attached to the upper surface of the caseplate 22 which has the membrane 26 attached thereto, a unitary laminate is formed comprising the partial layer 40 and the caseplate 22 and the membrane 26 as shown in FIG. 6. Thus, when the caseplate 22 is removed to insert or remove an electronic device the partial layer and the membrane are moved along with the caseplate 22 by being part of the same laminate. As shown in, for example, FIGS. 1, 7 and 8 the region 28 is an offset region with regard to the remaining region of the membrane which is located at the access opening 24. The offset 28 region is in a plane which is displaced from and non-coplanar with the remaining region of the membrane at the access opening.

FIGS. 9-11 show an alternative form of enclosure where the liner 26 is in-molded with caseplate 22 on the exterior surface of caseplate 22. As shown therein liner 26 extends downwardly into and around the access opening 24.

Although caseplate 22 is preferably detachably mounted to case 12, the invention could be broadly practiced where the electronic device 18 is mounted in the compartment formed by base 14 and peripheral wall 16 and then the caseplate 22 is permanently bonded or otherwise secured to peripheral wall 16 particularly where device 18 is a disposable device or is a device where it is desired to provide a hermetically sealed environment or container for the device.

Liner 26 is preferably made of uniform thickness. If desired, however, the tactile region 28 could be slightly thinner to enhance its flexibility thereby assuring that the switch can be manipulated through the tactile region 28.

What is claimed is:

1. An enclosure for an electronic device having a switch on its outer surface, said enclosure comprising a case having a rigid base and an outwardly extending peripheral wall to form a compartment for receiving the electronic device with the switch being on an outer surface remote from said base, said case being separate and distinct from the electronic device, a rigid caseplate mounted to said peripheral wall for enclosing the electronic device, said rigid caseplate being separate and distinct from both the electronic device and said base and being detachably mounted to expose said compartment and permit the electronic device to be selectively inserted into and removed from said compartment, said caseplate having an interior surface disposed toward said base within said compartment and an exterior surface remote from said base, an access opening extending through said caseplate from said interior surface to said exterior surface for being disposed at the switch to provide access to the switch to permit the switch to be manipulated without removing the electronic device from said compartment, a liner in the form of a thin membrane mounted in surface to surface contact with one of said interior surface and said exterior surface of said caseplate, said membrane completely covering said access opening to thereby completely cover the top of the switch and to permit manipulation of the switch by a user pressing against said membrane, said caseplate and said membrane forming a unitary laminate whereby detachment of said caseplate from said compartment also results in said membrane being detached from said compartment and moved away from the switch, said membrane having an offset region and a remaining region at said access opening, said offset region being in a plane which is displaced from and non-coplanar with said remaining region, and said offset region being surrounded by said remaining region.

2. The enclosure of claim 1 wherein said membrane is adhesively secured to said caseplate.

3. The enclosure of claim 1 wherein said membrane is in-molded to said caseplate.

4. The enclosure of claim 1 including a removable card insertable within said compartment for being between said caseplate and the device.

5. The enclosure of claim 1 wherein said membrane contains art work.

6. The enclosure of claim 1 in combination with an electronic device mounted in said compartment, including a card detachably inserted between said device and said caseplate.

7. The enclosure of claim 1 wherein said offset region is a tactile region which is more flexible than said remaining region.

8. The enclosure of claim 1 including a partial layer mounted to and covering at least a portion of said caseplate, and said partial layer having an open area extending completely therethrough in registry with said access opening.

9. The enclosure of claim 8 wherein said partial layer is comolded to said caseplate.

10. The enclosure of claim 8 wherein said open area is a first open area, partial layer including a second open area spaced from said first open area, and both said first open area and said second open area being surrounded by said partial layer.

11. The enclosure of claim 8 wherein said partial layer is made of metal.

12. The enclosure of claim 8 wherein said partial layer is mounted to said exterior surface of said caseplate, said partial layer being colored, and said enclosure is transparent except for said partial layer.

13. The enclosure of claim 1 wherein said enclosure is entirely transparent.

14. The enclosure of claim 1 in combination with an electronic device mounted in said compartment, and artwork being located between said membrane and said electronic device.

15. The enclosure of claim 14 wherein said artwork is three-dimensional.

16. The enclosure of claim 1 wherein said caseplate is completely detachably snap mounted to said peripheral wall of said base.

17. The enclosure of claim 1 wherein said caseplate comprises a plate having a peripheral wall extending downwardly from said plate at least partially around the periphery of said plate, and said caseplate peripheral wall being of substantially lesser height than said peripheral wall of said base whereby the entire electronic device could be within said peripheral wall of said base.

18. The enclosure of claim 1 in combination with said electronic device wherein said electronic device is removably mounted in said case.

19. The enclosure of claim 1 wherein said membrane has a thickness in the range of 0.005 to 0.020 inches.

20. The enclosure of claim 1 wherein said membrane is mounted to said interior surface of said caseplate, and said offset region extending into said access opening toward said exterior surface of said caseplate.

21. The enclosure of claim 1 wherein said access opening is of circular shape, and said offset region being of circular shape concentric with said access opening.

22. The enclosure of claim 1 wherein said partial layer is mounted to said exterior surface of said caseplate, and said partial layer is colored.

23. The enclosure of claim 8 wherein said open area and said access opening are of circular shape with a common center point, said partial layer having a second open area displaced from said access area which is of rectangular shape, and said partial layer completely covering said caseplate except for said circular open area and said rectangular open area.

24. An enclosure for an electronic device having a switch on its outer surface, said enclosure comprising a case having a rigid base and an outwardly extending peripheral wall around at least a portion of said base to form a compartment for receiving the electronic device with the switch being on an outer surface of the device remote from said base said case being separate and distinct from the electronic device, a rigid caseplate completely detachably snap mounted to at least a portion of said peripheral wall for enclosing the electronic device to permit the electronic device to be selectively inserted into and removed from the case, said caseplate having an interior surface disposed toward said base within said compartment and an exterior surface remote from said base, an access opening extending through said caseplate from said interior surface to said exterior surface for being disposed at the switch to provide access to the switch to permit the switch to be manipulated without removing the electronic device from said compartment, a liner in the form of a thin membrane mounted in surface to surface contact with one of said interior surface and said exterior surface of said caseplate, said membrane completely covering said access opening to thereby completely cover the top of the switch and to permit manipulation of the switch by a user pressing against said membrane, and said caseplate and said membrane forming a unitary laminate whereby detachment of said caseplate from said compartment also results in said membrane being detached from said compartment and moved away from the switch.

25. An enclosure for an electronic device having a switch on its outer surface, said enclosure comprising a case having a rigid base and an outwardly extending peripheral wall to form a compartment for receiving the electronic device with the switch being on an outer surface remote from said base, said case being separate and distinct from the electronic device, a rigid caseplate mounted to said peripheral wall for enclosing the electronic device, said rigid caseplate being separate and distinct from both the electronic device and said base and being detachably mounted to expose said compartment and permit the electronic device to be selectively inserted into and removed from said compartment, said caseplate having an interior surface disposed toward said base within said compartment and an exterior surface remote from said base, an access opening extending through said caseplate from said interior surface to said exterior surface for being disposed at the switch to provide access to the switch to permit the switch to be manipulated without removing the electronic device from said compartment, a liner in the form of a thin membrane mounted in surface to surface contact with one of said interior surface and said exterior surface of said caseplate, said membrane completely covering said access opening to thereby completely cover the top of the switch and to permit manipulation of the switch by a user pressing against said membrane, a partial layer mounted to and covering at least a portion of said caseplate, said partial layer having an outer surface, said membrane being recessed below said outer surface of said partial layer, said partial forming part of a unitary laminate with said caseplate and said membrane whereby detachment of said caseplate from said compartment also results in said partial layer and said membrane being detached from said compartment and moved away from the switch, and said partial layer having an open area extending completely therethrough in registry with said access opening whereby said partial layer does not interfere with manipulation of the switch through said membrane.

26. The enclosure of claim 25 wherein said partial layer is mounted to said exterior surface of said caseplate, and said partial layer is colored.

27. The enclosure of claim 25 wherein said open area and said access opening are of circular shape with a common center point, said partial layer having a second open area displaced from said access area which is of rectangular shape, and said partial layer completely covering said caseplate except for said circular open area and said rectangular open area.

28. The enclosure of claim 25 in combination with said electronic device wherein said electronic device is removably mounted in said case.

* * * * *